US010994544B2

(12) United States Patent
Sai et al.

(10) Patent No.: US 10,994,544 B2
(45) Date of Patent: May 4, 2021

(54) CLEANING LIQUID AND METHOD OF CLEANING INK-JET PRINTER

(71) Applicant: Nippon Kayaku Kabushiki Kaisha, Tokyo (JP)

(72) Inventors: Ha Sai, Tokyo (JP); Hirotoshi Takahashi, Tokyo (JP); Tetsuya Iwazaki, Tokyo (JP)

(73) Assignee: Nippon Kayaku Kabushiki Kaisha, Tokyo (JP)

( * ) Notice: Subject to any disclaimer, the term of this patent is extended or adjusted under 35 U.S.C. 154(b) by 28 days.

(21) Appl. No.: 16/382,625

(22) Filed: Apr. 12, 2019

(65) Prior Publication Data

US 2019/0344569 A1 Nov. 14, 2019

(30) Foreign Application Priority Data

May 8, 2018 (JP) ..... JP2018-089623

(51) Int. Cl.

| | |
|---|---|
| ***B41J 2/165*** | (2006.01) |
| ***B41J 2/17*** | (2006.01) |
| ***C11D 3/16*** | (2006.01) |
| ***C11D 1/72*** | (2006.01) |

(52) U.S. Cl.

CPC ..... *B41J 2/16552* (2013.01); *B41J 2/1707* (2013.01); *C11D 1/72* (2013.01); *C11D 3/164* (2013.01)

(58) Field of Classification Search

CPC ..... B41J 2/16552; B41J 2/1707

See application file for complete search history.

(56) References Cited

U.S. PATENT DOCUMENTS 4,968,596 A * 11/1990 Inoue ..... G03C 1/48546 430/378
5,825,380 A * 10/1998 Ichizawa ..... B41J 2/16552 347/28
6,604,809 B2 * 8/2003 Katsuragi ..... B41J 2/16552 347/28
6,648,464 B1 * 11/2003 Parazak ..... B41J 2/16552 347/100
6,666,553 B2 * 12/2003 Han-Adebekun .... C09D 11/322 106/31.13
2002/0008725 A1 * 1/2002 Katsuragi ..... B41J 2/16552 347/28
2003/0035917 A1 * 2/2003 Hyman ..... B41M 5/36 428/67
2007/0037902 A1 * 2/2007 McCovick ..... C09D 11/30 523/160
2010/0062962 A1 * 3/2010 Momose ..... B41J 2/1707 510/170
2011/0069114 A1 * 3/2011 Ikoshi ..... C11D 7/14 347/28
2013/0252869 A1 * 9/2013 Oh ..... C11D 1/65 510/155
2015/0159123 A1 * 6/2015 Klipp ..... G03F 7/40 430/325
2017/0158899 A1 * 6/2017 Willems ..... C09D 11/38

FOREIGN PATENT DOCUMENTS

| | | | |
|---|---|---|---|
| JP | 4397220 | B2 | 1/2010 |
| JP | 4649823 | B2 | 3/2011 |
| JP | 5027444 | B2 | 9/2012 |
| JP | 5618250 | B2 | 11/2014 |
| JP | 5819205 | B2 | 11/2015 |
| JP | 5819206 | B2 | 11/2015 |

* cited by examiner

*Primary Examiner* — John Zimmermann

(74) *Attorney, Agent, or Firm* — Knobbe Martens Olson & Bear LLP

(57) ABSTRACT

A cleaning liquid including a compound represented by the following formula (1):

$$(CH_3)_3C—R—O(C_4H_8O)_L—(C_3H_6O)_m—(C_2H_4O)_n—H \quad (1)$$

and water; and a method of cleaning an ink-jet printer using the cleaning liquid. In the formula (1), R represents a linear or branched C1 to C5 hydrocarbon group, and L, m, and n each represent the average number of repeats, and L≥0, m≥0, n>0, and (L+m)/n=1.5/1 to 1/1.5.

9 Claims, No Drawings

CLEANING LIQUID AND METHOD OF CLEANING INK-JET PRINTER

RELATED APPLICATION

This application claims priority to Japanese Patent Application No. 2018-089623, filed May 8, 2018, the entire content of which is incorporated herein by reference.

BACKGROUND OF THE INVENTION

Field of the Invention

The present invention relates to a cleaning liquid, in particular a cleaning liquid used for an ink-jet printer, and also relates to a method of cleaning an ink-jet printer using the above cleaning liquid.

Related Art

One of the representative methods for color printing is a method of printing using an ink-jet printer (the ink-jet printing method). This method involves generating a droplet of an ink, and allowing the droplet to adhere on a substrate such as paper, thereby performing printing.

In recent years, advances have been made in the ink-jet printing method to increase industrial applications thereof. Coloring matters contained in ink-jet inks are broadly classified into water-soluble coloring matters and water-insoluble coloring matters. Among these, water-insoluble coloring matters, as represented by pigments, generally have superior robustness in various properties as compared with water-soluble coloring matters. For this reason, many industrial ink-jet inks include a water-insoluble coloring matter.

Substrates for use in industrial applications are diversified into various types of paper, fibers, films, and the like. Many nonabsorbent substrates or poorly absorbent substrates are also used. As inks used for printing on nonabsorbent substrates or poorly absorbent substrates, known are non-water-based solvent inks, curable inks, and the like. However, a water-based ink which can be also used to print on a nonabsorbent substrate or a poorly absorbent substrate is strongly demanded in view of safety for natural environment, living bodies, and the like. Such a water-based ink may include a water-insoluble coloring matter and a dispersing agent, and in general may further include a polymer, wax, and others in order to improve rubfastness, solvent resistance, and the like. Consequently, such a water-based ink may have a large content of solid matter, and thus tend to be dried very easily. A dried ink often forms solid matter in a nozzle portion of an ink-jet head and/or an ink flow path, resulting in clogging when stored for long time, stored under high-temperature or low-humidity environments, and the like. If clogging occurs within an ink-jet head as described above, an ink can not be stably discharged, resulting in disadvantageously reduced image density. Accordingly, improvements are commonly made in industrial ink-jet heads. For example, a nozzle portion may include a cap member to prevent a dried ink. Nonetheless, a dried ink has remained difficult to be completely avoided, depending on storage environments.

In view of the above situations, there exist strong demands for a cleaning liquid (may also be referred to as a washing liquid, a maintenance liquid, and the like) capable of dissolving and removing solid matter even if the solid matter is formed when an ink is dried, and clogs an ink-jet head. Patent Documents 1 to 6 disclose cleaning liquids used for cleaning ink-jet printers.

Patent Document 1: Japanese Patent No. 5027444
Patent Document 2: Japanese Patent No. 4649823
Patent Document 3: Japanese Patent No. 4397220
Patent Document 4: Japanese Patent No. 5618250
Patent Document 5: Japanese Patent No. 5819206
Patent Document 6: Japanese Patent No. 5819205

SUMMARY OF THE INVENTION

An object of the present invention is to provide a cleaning liquid capable of dissolving and removing solid matter even if the solid matter is formed when a coloring ink is dried. Another object of the present invention is to provide a method of cleaning an ink-jet printer using the above cleaning liquid.

Specific means for achieving the above objects include the following embodiments.

1) A cleaning liquid including a compound represented by the following formula (1):

$$(CH_3)_3C—R—O(C_4H_8O)_L—(C_3H_6O)_m—(C_2H_4O)_n—H \quad (1)$$

wherein R represents a linear or branched C1 to C5 hydrocarbon group, and L, m, and n each represent the average number of repeats, and $L \geq 0$, $m \geq 0$, $n > 0$, and $(L+m)/n = 1.5/1$ to $1/1.5$; and water.

2) The cleaning liquid according to 1), wherein the content of the compound represented by the formula (1) is 0.01% by mass to 5% by mass.

3) The cleaning liquid according to 1), further including one or more glycol ethers.

4) The cleaning liquid according to 3), wherein the content of the one or more glycol ethers is 0.1% by mass to 15% by mass.

5) The cleaning liquid according to 1), further including one or more organic solvents other than the one or more glycol ethers.

6) The cleaning liquid according to 5), wherein the content of the one or more organic solvents is 0.1% by mass to 35% by mass.

7) Use of the cleaning liquid according to 1) for cleaning an ink-jet printer.

8) A method of cleaning an ink-jet printer, the method including: contacting the cleaning liquid according to 1) with solid matter of an ink-jet ink adhering on the ink-jet printer, thereby dissolving and removing the solid matter.

9) The method of cleaning according to 8), the method including: filling an ink-jet head with the cleaning liquid, and passing the cleaning liquid through an ink flow path, thereby dissolving and removing the solid matter.

The present invention can provide a cleaning liquid capable of dissolving and removing solid matter even if the solid matter is formed when a coloring ink is dried, and also can provide a method of cleaning an ink-jet printer using the above cleaning liquid.

DETAILED DESCRIPTION OF THE INVENTION

The terms "%" and "part" as used herein are both based on mass unless otherwise specifically noted.

<Cleaning Liquid>

A cleaning liquid according to the present embodiment includes a compound represented by the following formula (1):

$$(CH_3)_3C—R—O(C_4H_8O)_L—(C_3H_6O)_m—(C_2H_4O)_n—H \quad (1)$$

wherein in the formula (1), R represents a linear or branched C1 to C5 hydrocarbon group, and L, m, and n each represent the average number of repeats, and L≥0, m≥0, n>0, and (L+m)/n=1.5/1 to 1/1.5; and water.

Below, components which may be included in the cleaning liquid according to the present embodiment will be described in detail.

[Compound Represented by Formula (1)]

In the above formula (1), examples of the hydrocarbon group represented by R include, for example, linear alkylene groups such as methylene, ethylene, propylene, butylene, and pentylene; branched alkylene groups such as 1-methyl-1,4-butanediyl, 2-methyl-1,4-butanediyl, 3-methyl-1,4-butanediyl, 4-methyl-1,4-butanediyl, 1-methyl-1,3-propanediyl, 2-methyl-1,3-propanediyl, 3-methyl-1,3-propanediyl, 1-methyl-1,2-ethanediyl, and 2-methyl-1,2-ethanediyl; and the like. The carbon number of R is preferably C2 to C5, more preferably C3 to C5, and even more preferably C5 in view of achieving high cleaning performance. Further, R is preferably a branched hydrocarbon group in view of achieving high cleaning performance.

In the above formula (1), L, m, and n are such that (L+m)/n is preferably 1.4/1 to 1/1.5, more preferably 1.4/1 to 1/1.4, and even more preferably 1.3/1 to 1/1.3 in view of achieving high cleaning performance.

Further, L, m, and n are preferably such that L is 0, and m/n is 1.3/1 to 1/1.3 in view of achieving high cleaning performance.

The number average molecular weight of the compound represented by the above formula (1) is usually 100 to 5000, preferably 200 to 4000, more preferably 250 to 3500, and even more preferably 250 to 2000.

The compound represented by the above formula (1) can be synthesized by a known method. It can be also obtained as a commercial product. Specific commercial products include, for example, TEGO Wet 500, 505, and 510 available from EVONIK. TEGO Wet 500, 505, and 510 have Rs, Ls, m's, n's, and number average molecular weights as measured by LC-MS as follows.

TEGO Wet 500

R: a 2-methyl-1,4-butanediyl group, L=0, m/n≈1.0/1.0, the number average molecular weight: about 300 to 1000

TEGO Wet 505

R: a 2-methyl-1,4-butanediyl group, m=0, L/n≈1.0/1.3, the number average molecular weight: about 300 to 1000

TEGO Wet 510

R: a 2-methyl-1,4-butanediyl group, L=0, m/n≈1.3/1.0, the number average molecular weight: about 300 to 1000

The total content of the compound represented by the above formula (1) in the total mass of a cleaning liquid is preferably 0.01% to 5%, more preferably 0.02% to 4%, and even more preferably 0.05% to 3%.

[Water]

The cleaning liquid according to the present embodiment includes water as a solvent. For water, ion-exchanged water, distilled water, or the like is preferably used for the purpose of reducing ionic impurities as low as possible.

The content of water in the total mass of a cleaning liquid is preferably 40% to 85%, more preferably 50% to 80%, and even more preferably 60% to 75%.

[Glycol Ether]

The cleaning liquid according to the present embodiment preferably includes glycol ether. For glycol ether, preferred is a monoalkyl ether of di or tri C2 to C4 alkylene glycol. Examples of the C2 to C4 alkylene glycol moiety include ethylene glycol, propylene glycol, and butylene glycol. Among these, ethylene glycol and propylene glycol are preferred, and ethylene glycol is more preferred. The carbon number of the alkyl in the monoalkyl ether moiety is usually C1 to C6, preferably C1 to C5, more preferably C2 to C4, even more preferably C3 to C4, and in particular preferably C4.

Specific examples of glycol ether include, for example, ethylene glycol monomethyl ether, ethylene glycol monoethyl ether, diethylene glycol monoethyl ether, diethylene glycol monopropyl ether, diethylene glycol monobutyl ether (butyl diglycol), triethylene glycol monomethyl ether, triethylene glycol monoethyl ether, ethylene glycol monoallyl ether, ethylene glycol monoisopropyl ether, diethylene glycol monomethyl ether, propylene glycol monopropyl ether, triethylene glycol monobutyl ether, and the like. Among these, butyl diglycol is preferred.

The total content of glycol ether in the total mass of a cleaning liquid is usually 0% to 15%, preferably 0.1% to 15%, more preferably 0.2% to 13%, and even more preferably 0.5% to 10%.

[Additives]

The cleaning liquid according to the present embodiment may further include an additive other than the compound represented by the above formula (1), water, and glycol ether. Additives include, for example, organic solvents (but except for glycol ether), surfactants (but except for the compound represented by the above formula (1)), antiseptic agents, antifungal agents, pH adjusters, chelating reagents, rust-preventive agents, water-soluble ultraviolet absorbing agents, antioxidants, and the like. These additives may be used alone or in combination of two or more.

The total content of an organic solvent in the total mass of the cleaning liquid according to the present embodiment is usually 0% to 40%, preferably 0.1% to 35%, more preferably 0.2% to 30%, and even more preferably 0.5% to 25%. Further, the total content of an additive other than an organic solvent in the total mass of the cleaning liquid according to the present embodiment is usually 0% to 30%, preferably 0% to 20%, more preferably 0% to 10%, and even more preferably 0% to 5%.

The cleaning liquid according to the present embodiment does not substantially include a coloring matter. The phrase "does not substantially include a coloring matter" as used herein means that no coloring matter is intentionally added to a cleaning liquid.

Organic solvents include, for example, C1 to C6 alkanols each having one hydroxy group such as methanol, ethanol, propanol, isopropanol, butanol, isobutanol, secondary butanol, and tertiary butanol; amides such as N,N-dimethylformamide and N,N-dimethylacetamide; lactams such as 2-pyrrolidone, N-methyl-2-pyrrolidone, and N-methylpyrrolidin-2-one; cyclic urea such as 1,3-dimethylimidazolidin-2-one and 1,3-dimethylhexahydropyrimid-2-one; ketone- or keto-alcohols such as acetone, 2-methyl-2-hydroxypentan-4-one, and ethylene carbonate; cyclic ethers such as tetrahydrofuran and dioxane; mono-, oligo-, or poly-alkylene glycols or thioglycols each having a C2 to C8 alkylene group such as ethylene glycol, diethylene glycol, 1,2-propylene glycol, 1,3-propylene glycol, 1,4-butylene glycol, 1,6-hexylene glycol, 1,2-hexanediol, 1,2-pentanediol, 4-methyl-1,2-pentanediol, 3,3-dimethyl-1,2-butanediol, 1,2-octanediol, 5-methyl-1,2-hexandiol, 4-methyl-1,2-hexandiol, 4,4-dimethyl-1,2-pentanediol, diethylene glycol, triethylene glycol, tetraethylene glycol, dipropylene glycol, polyethylene glycol or polypropylene glycol having a molecular weight of 400 or more, thiodiglycol, or dithiodiglycol; polyols (triols) such as glycerin, diglycerin, hexane-1,2,6-triol, and trimethylolpropane; γ-butyrolactone, dimethyl sulfoxide; and the like.

Surfactants include anionic, cationic, nonionic, amphoteric, silicon-based, and fluorine-based surfactants. Among these, a nonionic surfactant is preferred.

Anionic surfactants include, for example, alkylsulfocarboxylate, α-olefin sulfonate, polyoxyethylene alkyl ether acetate, polyoxyethylene alkyl ether sulfate, N-acylamino acid or salts thereof, N-acylmethyltaurine salts, alkylsulfate polyoxyalkyl ether sulfate, alkylsulfate polyoxyethylene alkyl ether phosphate, rosin acid soap, castor oil sulfate ester salts, lauryl alcohol sulfate ester salts, alkylphenol-type phosphate ester, alkyl-type phosphate ester, alkylallylsulfonate, diethyl sulfosuccinate, diethylhexyl sulfosuccinate, dioctyl sulfosuccinate, and the like.

Cationic surfactants include, for example, 2-vinylpyridine derivatives, poly-4-vinylpyridine derivatives, and the like.

Nonionic surfactants include, for example, these based on ether such as polyoxyethylene nonylphenyl ether, polyoxyethylene octylphenyl ether, polyoxyethylene dodecylphenyl ether, polyoxyethylene oleyl ether, polyoxyethylene lauryl ether, polyoxyethylene alkyl ether, and polyoxyethylene distyrenated phenyl ether (for example, Emulgen A-60, A-90, and A-500 available from Kao Corp.); those based on ester such as polyoxyethylene oleate ester, polyoxyethylene distearate ester, sorbitan laurate, sorbitan monostearate, sorbitan monooleate, sorbitan sesquioleate, polyoxyethylene monooleate, and polyoxyethylene stearate; those based on acetyleneglycols (alcohols) such as 2,4,7,9-tetramethyl-5-decyne-4,7-diol, 3,6-dimethyl-4-octyne-3,6-diol, and 3,5-dimethyl-1-hexyn-3-ol; those based on polyglycol ether; and the like. Commercial products thereof include, for example, Surfynol 104, 104PG50, 82, 420, 440, 465, and 485, and Olfine STG available from Nissin Chemical Industry Co., Ltd.; Emulgen A-60, A-90, and A-500 available from Kao Corp.; and the like Amphoteric surfactants include, for example, lauryldimethylaminoacetic acid betaine, 2-alkyl-N-carboxymethyl-N-hydroxyethyl imidazolinium betaine, coconut oil fatty acid amide propyldimethylaminoacetic acid betaine, polyoctylpolyaminoethylglycine, imidazoline derivatives and the like.

Silicon-based surfactants include, for example, polyether modified siloxane, polyether modified polydimethylsiloxane, and the like. Examples thereof include Dinol 960 and 980 available from Air Products; Silface SAG001, SAG002, SAG003, SAG005, SAG503A, SAG008, SAG009, and SAG010 available form Nissin Chemical Industry Co., Ltd.; and BYK-345, 347, 348, 349, 3455, LP-X23288, LP-X23289, and LP-X23347 available from BYK Japan K.K.; TEGO Twin 4000, TEGO Wet KL245, 250, 260, 265, 270, and 280 available from from Evonik Tego Chemie.

Fluorine-based surfactants include, for example, perfluoroalkylsulfonic compounds, perfluoroalkylcarboxylic acid-based compounds, perfluoroalkylphosphate compound, perfluoroalkylethylene oxide adducts, and polyoxyalkylene ether polymer compounds each having a perfluoroalkylether group in a side chain, and the like.

Antiseptic agents include, for example, organic sulfur-based, organic nitrogen sulfur-based, organic halogen-based, haloallylsulfone-based, iodopropargyl-based, haloalkylthio-based, nitrile-based, pyridine-based, 8-oxyquinoline-based, benzothiazole-based, isothiazoline-based, dithiol-based, pyridinoxide-based, nitropropane-based, organic tin-based, phenol-based, quaternary ammonium salt-based, triazine-based, thiazine-based, anilide-based, adamantane-based, dithiocarbamate-based, brominated indanon-based, benzyl bromoacetate-based, inorganic salt-based compounds, and the like. Specific examples of commercial products of antiseptic agents include Proxel GXL (S) and XL-2 (S) available from Arch Chemicals, Inc., and the like.

Antifungal agents include, for example, sodium dehydroacetate, sodium benzoate, sodium pyridinethione-1-oxide, p-hydroxybenzoic acid ethyl ester, and 1,2-benzisothiazolin-3-one and salts thereof, and the like.

Any substance may be used as a pH adjuster as long as the pH of a cleaning agent to be prepared can be adjusted to 5 to 11 without causing adverse effects on the cleaning agent. Specific examples thereof include, for example, alkanolamines such as diethanolamine, triethanolamine, and N-methyldiethanolamine; hydroxides of alkali metals such as lithium hydroxide, sodium hydroxide, and potassium hydroxide; ammonium hydroxide (aqueous ammonia); carbonates of alkali metals such as lithium carbonate, sodium carbonate, sodium hydrogen carbonate, and potassium carbonate; alkali-metal salts of organic acids such as sodium silicate and potassium acetate; inorganic bases such as disodium phosphate; and the like.

Chelating reagents include, for example, disodium ethylenediaminetetraacetate, sodium nitrilotriacetate, sodium hydroxyethylethylenediaminetriacetate, sodium diethylenetriaminepentaacetate, sodium uracildiacetate and the like.

Rust-preventive agents include, for example, hydrogen sulfite salts, sodium thiosulfate, ammonium thioglycolate, diisopropylammonium nitrite, pentaerythritol tetranitrate, dicyclohexylammonium nitrite, and the like.

Water-soluble ultraviolet absorbing agents include, for example, sulfonated benzophenone-based compounds, benzotriazole-based compounds, salicylic acid-based compounds, cinnamic acid-based compounds, triazine-based compounds, and the like.

As antioxidants, for example, various organic and metal complex-based anti-fading agents can be used. Organic anti-fading agents include, for example, hydroquinones, alkoxyphenols, dialkoxyphenols, phenols, anilines, amines, indans, chromans, alkoxyanilines, heterocycles, and the like.

The cleaning liquid according to the present embodiment may include one from one category of the aforementioned components, or may include two or more. For example, the cleaning liquid according to the present embodiment may include one compound of the compounds represented by the above formula (1), or may include two or more compounds of the compounds represented by the above formula (1). The same applies to other components.

[Method of Preparing Cleaning Liquid]

The cleaning liquid according to the present embodiment can be obtained by adding the compound represented by the above formula (1), water, and, if required, glycol ether and/or an additive, and performing thorough stirring. The resulting cleaning liquid may be subjected to precision filtration in order to remove contaminants. In particular, the cleaning liquid is preferably subjected to precision filtration when it is used to fill an ink-jet head. For precision filtration, a membrane filter, a glass filter paper, and the like can be used. The pore size of a filter and the like for performing precision filtration is usually 0.5 μm to 20 μm, preferably 0.5 μm to 10 μm.

The pH of the cleaning liquid according to the present embodiment at 25° C. is usually pH 5 to 11, preferably pH 7 to 10.5 in order to prevent the members of an ink-jet printer from undergoing corrosion. The surface tension of the cleaning liquid according to the present embodiment at 25° C. is usually 10 mN/m to 50 mN/m, preferably 20 mN/m to 40 mN/m. The viscosity of the cleaning liquid according to the present embodiment at 25° C. is usually 30 mPa~s or less, preferably 20 mPa~s or less, and the lower limit is around 0.1 mPa~s.

[Applications of Cleaning Liquid]

The cleaning liquid according to the present embodiment can be used for dissolving and removing solid matter resulted from solidification of a water-based ink including various coloring agents. Water-based inks include water-based inks including water-soluble dyes such as acid dyes, direct dyes, and reactive dyes; water-based inks including water-insoluble coloring matters such as disperse dyes and pigments; and the like. The cleaning liquid according to the present embodiment is preferably used to dissolve and remove solid matter resulted from solidification of a water-based ink including a water-insoluble coloring matter, in particular a pigment in view of the high cleaning capability of the cleaning liquid according to the present embodiment.

<Method of Cleaning Ink-Jet Printer>

The method of cleaning an ink-jet printer according to the present embodiment involves contacting the aforementioned cleaning liquid according to the present embodiment with solid matter of an ink-jet ink adhering on the ink-jet printer, thereby dissolving and removing the solid matter.

Ink-jet inks include water-based inks including water-soluble dyes such as acid dyes, direct dyes, and reactive dyes; water-based inks including water-insoluble coloring matters such as disperse dyes and pigments; and the like. The cleaning liquid according to the present embodiment is capable of dissolving and removing solid matter of a water-based ink including a water-insoluble coloring matter, in particular a pigment by virtue of the high cleaning capability of the cleaning liquid according to the present embodiment.

There is no particular limitation for the method of contacting the cleaning liquid according to the present embodiment with solid matter of an ink-jet ink. For example, a cleaning liquid may be absorbed by sponge and the like, and contaminants in a portion on which solid matter of a coloring ink adheres may be wiped off. Alternatively, an ink-jet head may be filled with a cleaning liquid in place of a coloring ink to pass the cleaning liquid through an ink flow path when the coloring ink is dried on the ink-jet head, resulting in serious contamination of the ink-jet head. The cleaning liquid passed through as described above can dissolve and remove solid matter of a coloring ink adhering within an ink-jet head, within an ink flow path, on a nozzle, and the like.

With regard to all of the aforementioned items, combinations of those preferred are more preferred, and combinations of those more preferred are even more preferred. The same applies to combinations of those preferred and those more preferred, combinations of those more preferred and those even more preferred, and the like.

EXAMPLES

Below, the present invention will be described more specifically with reference to Examples, but the present invention shall not be limited to the following Examples. Unless otherwise specifically noted, preparation of cleaning liquids and coloring inks were all performed under stirring. Further, the term "water" used in Examples refers to ion-exchanged water.

Examples 1 and 2

Preparation of Cleaning Liquids

The components shown in Table 1 below were mixed accordingly to obtain liquids each having a total amount of 100 parts. Then the resulting liquids were each filtered through a membrane filter with a pore size of 3 μm to obtain cleaning liquids of Examples 1 and 2.

Comparative Examples 1 to 6

Preparation of Comparative Cleaning Liquids

Comparative cleaning liquids of Comparative Examples 1 to 6 were obtained as in Examples 1 and 2 except that the components shown in Table 1 below were used accordingly.

Abbreviations and the like used in Table 1 below have the following meanings. The numerical values in Table 1 are expressed in terms of "parts".

Gly: glycerin
2Py: 2-pyrrolidone
BDG: butyl diglycol
SN465: a nonionic surfactant available from Nissin Chemical Industry Co., Ltd., Surfynol 465
EP-7025: a nonionic surfactant available from Nippon Shokubai Co., Ltd., Softanol EP-7025
LS-106: a nonionic surfactant available from Kao Corp., Emulgen LS-106
D-1502: a nonionic surfactant available from Takemoto Oil & Fat, Inc., Pionin D-1502
D-1305P: a nonionic surfactant available from Takemoto Oil & Fat, Inc., Pionin D-1305P
TW500: a nonionic surfactant available from EVONIK, TEGO Wet 500
TW510: a nonionic surfactant available from EVONIK, TEGO Wet 510
TEA: triethanolamine
GXL(S): Proxel GXL(S)

TABLE 1

| | Example | | Comparative Example | | | | | |
|---|---|---|---|---|---|---|---|---|
| Components | 1 | 2 | 1 | 2 | 3 | 4 | 5 | 6 |
| Gly | 15 | 15 | 15 | 30 | 15 | 15 | 15 | 15 |
| 2Py | 5 | 5 | 5 | — | 5 | 5 | 5 | 5 |
| BDG | 10 | 10 | 10 | 10 | 10 | 10 | 10 | 10 |
| SN465 | — | — | 0.5 | — | — | — | — | — |
| EP-7025 | — | — | — | — | 0.5 | — | — | — |
| LS-106 | — | — | — | — | — | 0.5 | — | — |
| D-1502 | — | — | — | — | — | — | 0.5 | — |
| D-1305P | — | — | — | — | — | — | — | 0.5 |
| TW500 | 0.5 | — | — | — | — | — | — | — |
| TW510 | — | 0.5 | — | — | — | — | — | — |
| TEA | 0.2 | 0.2 | 0.2 | 0.2 | 0.2 | 0.2 | 0.2 | 0.2 |
| GXL(S) | 0.1 | 0.1 | 0.1 | 0.1 | 0.1 | 0.1 | 0.1 | 0.1 |
| Water | Remainder | | | | Remainder | | | |
| Total | 100 | | | | 100 | | | |

Preparation Example 1: Preparation of Resin A

Joncryl 678 (the mass average molecular weight: 8500) (25 parts) and triethanolamine (14.3 parts) were dissolved in ion-exchanged water (60.7 parts), and stirred for 1 hour to obtain a solution. The resulting solution is referred to as a "resin A".

Preparation Example 2: Preparation of Coloring Dispersion Liquid

A block copolymer described in Synthesis Example 3 of WO 2013/115071 was prepared, and the resulting polymer dispersant (5 parts) was dissolved in 2-butanone (20 parts) to obtain a homogeneous solution. To this solution, added was a liquid in which sodium hydroxide (0.4 parts) was dissolved in water (50.6 parts). The resin A (4 parts) was then further added and stirred for 1 hour to obtain an emulsified liquid. To the above emulsified liquid, C. I. Pigment Yellow 74 (HANSA YELLOW 5GX 01-JP available from Clariant) (25 parts) was added, and dispersed in a sand grinder under a condition of 1500 rpm for 15 hours to obtain a liquid. Water (100 parts) was added dropwise to the resulting liquid, which was then filtered to obtain a filtrate. Some of water and 2-butanone was distilled away from the resulting filtrate using an evaporator to obtain a coloring dispersion liquid having a pigment content of 12.4%. It is noted that the pigment content in the coloring dispersion liquid was determined in terms of the pigment content of the total solid matter in the liquid by the dry weight method using a MS-70 available from A&D Co., Ltd.

Preparation Example 3: Preparation of Resin B

According to Preparation Example 4 in WO2015/147192, a resin emulsion was prepared having an acid value of 6 KOH mg/g, a glass transition temperature of 0° C., and a solid content of 25%. This resin emulsion is referred to as a "resin B".

Preparation Example 4: Preparation of Coloring Ink

The components shown in Table 2 below were mixed accordingly to obtain a liquid having a total amount of 100 parts. Then the resulting liquid was filtered through a membrane filter with a pore size of 3 μm to obtain a coloring ink for use in evaluation of cleaning capabilities of the cleaning liquids.

Abbreviations and the like used in Table 2 below have the following meanings. The numerical values in Table 2 below are expressed in terms of "parts".

Coloring dispersion liquid: a coloring dispersion liquid from Preparation Example 2

TEG: triethylene glycol 1,2 HD:1,2-hexandiol

SN465: a nonionic surfactant available from Nissin Chemical Industry Co., Ltd., Surfynol 465

AQ515: a polyethylene wax available from BYK Japan K.K.,

AQUACER 515 (solid content: 35.0%)

TABLE 2

| Components | Preparation Example 4 |
|---|---|
| Coloring dispersion liquid | 32.3 |
| TEG | 25 |
| 12HD | 10 |
| SN465 | 0.5 |
| Resin B | 2 |

TABLE 2-continued

| Components | Preparation Example 4 |
|---|---|
| AQ515 | 1.4 |
| Water | Remainder |
| Total | 100 |

[Stability Tests of Cleaning Liquids]

The cleaning liquids from Examples 1 and 2 and Comparative Examples 1 to 6 were each allowed to stand at room temperature for 12 hours, and then the conditions of the cleaning liquids were visually observed to evaluate their stabilities. The following two evaluation criteria were used. Evaluation results are shown in Table 3 below.

Evaluation Criteria

A: No change was observed in the conditions of a cleaning liquid.

C: A liquid component was observed which was separated from a cleaning liquid and floated on the surface of the cleaning liquid.

[Tests for Cleanability of Cleaning Liquids]

The coloring ink obtained from Preparation Example 4 was added dropwise in an amount of 20 μL on a glass petri dish, and allowed to stand and be dried in a 60° C. incubator for 1 hour to obtain solid matter resulted from solidification of the coloring ink. To the resulting solid matter, added dropwise was 10 mL of each of the cleaning liquids from Examples 1 and 2 and Comparative Examples 1 to 6. Whether the solid matter was dissolved or not was then observed visually. The following 4 evaluation criteria were used. Evaluation results are shown in Table 3 below.

Evaluation Criteria

A: No residual solid matter was observed, and a homogeneous liquid was obtained.

B: Residual solid matter was slightly observed, but a substantially homogeneous liquid was obtained.

C: Residual solid matter was clearly observed, and a homogeneous liquid was not obtained.

D: No or almost no change in the shape of solid matter was observed.

TABLE 3

| | Example | | Comparative Example | | | | | |
|---|---|---|---|---|---|---|---|---|
| Test results | 1 | 2 | 1 | 2 | 3 | 4 | 5 | 6 |
| Stability | A | A | A | A | A | A | C | C |
| Cleanability | A | A | D | D | C | C | B | C |

The results shown in Table 3 clearly demonstrate that the cleaning liquids from Examples 1 and 2 have superior cleanability as compared with the cleaning liquids from Comparative Examples 1 to 6.

What is claimed is:

1. A cleaning liquid comprising a compound represented by the following formula (1):

$$(CH_3)_3C—R—O(C_4H_8O)_L—(C_3H_6O)_m—(C_2H_4O)_n—H \quad (1)$$

wherein R represents a 2 methyl-1,4-butanediyl group, and L, m, and n each represent the average number of repeats, and L≥0, m≥0, n>0, and (L+m)/n=1.5/1 to 1/1.5; and water.

2. The cleaning liquid according to claim 1, wherein the content of the compound represented by the above formula (1) is 0.01% by mass to 5% by mass.

3. The cleaning liquid according to claim 1, further comprising one or more glycol ethers.

4. The cleaning liquid according to claim 3, wherein the content of the one or more glycol ethers is 0.1% by mass to 15% by mass.

5. The cleaning liquid according to claim 1, further comprising one or more organic solvents other than the one or more glycol ethers.

6. The cleaning liquid according to claim 5, wherein the content of the one or more organic solvents is 0.1% by mass to 35% by mass.

7. The cleaning liquid of claim 1, wherein said cleaning liquid is used for cleaning an ink-jet printer.

8. A method of cleaning an ink-jet printer, the method comprising contacting the cleaning liquid according to claim 1 with solid matter of an ink-jet ink adhering on the ink-jet printer, thereby dissolving and removing the solid matter.

9. The method of cleaning according to claim 8, the method comprising filling an ink-jet head with the cleaning liquid, and passing the cleaning liquid through an ink flow path, thereby dissolving and removing the solid matter.

* * * * *